US007137452B2

(12) United States Patent
McVicker

(10) Patent No.: US 7,137,452 B2
(45) Date of Patent: Nov. 21, 2006

(54) METHOD OF DISABLING AND LOCKING OPEN A SAFETY VALVE WITH RELEASABLE FLOW TUBE FOR FLAPPER LOCKOUT

(75) Inventor: Van J. McVicker, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 167 days.

(21) Appl. No.: 10/254,261

(22) Filed: Sep. 25, 2002

(65) Prior Publication Data

US 2004/0056224 A1 Mar. 25, 2004

(51) Int. Cl.
*E21B 34/12* (2006.01)

(52) U.S. Cl. ..... 166/373; 166/316

(58) Field of Classification Search ..... 166/373, 166/317, 323, 332.8, 316; 251/83, 89, 58
See application file for complete search history.

(56) References Cited

U.S. PATENT DOCUMENTS

| | | | | | |
|---|---|---|---|---|---|
| 3,786,866 | A | * | 1/1974 | Tausch et al. | 166/323 |
| 3,981,358 | A | | 9/1976 | Watkins et al. | |
| 4,077,473 | A | | 3/1978 | Watkins | |
| 4,574,889 | A | | 3/1986 | Pringle | |
| 4,577,694 | A | | 3/1986 | Brakhage, Jr. | |
| 4,579,889 | A | | 4/1986 | Kaffen et al. | |
| 4,624,315 | A | | 11/1986 | Dickson et al. | |
| 4,641,707 | A | | 2/1987 | Akkerman | |
| 4,760,879 | A | | 8/1988 | Pringle | |
| 4,951,753 | A | * | 8/1990 | Eriksen | 166/321 |
| 4,967,845 | A | | 11/1990 | Shirk | |
| 4,986,358 | A | | 1/1991 | Lueders et al. | |
| 5,249,630 | A | * | 10/1993 | Meaders et al. | 166/373 |
| 5,343,955 | A | * | 9/1994 | Williams | 166/323 |
| 5,465,786 | A | * | 11/1995 | Akkerman | 166/323 |
| 5,564,675 | A | * | 10/1996 | Hill et al. | 166/323 |
| 5,636,661 | A | * | 6/1997 | Moyes | 166/332.8 |
| 6,059,041 | A | | 5/2000 | Scott | |
| 6,125,930 | A | | 10/2000 | Moyes | |
| 6,684,958 | B1 | * | 2/2004 | Williams et al. | 166/323 |
| 6,854,519 | B1 | * | 2/2005 | Deaton et al. | 166/332.8 |
| 6,902,006 | B1 | * | 6/2005 | Myerley et al. | 166/373 |
| 2002/0040788 | A1 | | 4/2002 | Hill, Jr., et al. | |

* cited by examiner

*Primary Examiner*—David Bagnell
*Assistant Examiner*—Matthew J. Smith
(74) *Attorney, Agent, or Firm*—Steve Rosenblatt

(57) ABSTRACT

A safety valve has a lock open feature that is actuated by expanding or penetrating the flow tube to disconnect the link between the piston in the hydraulic control system and the flow tube. In normal operation, downward movement of the piston moves the flow tube against a power spring. When the flow tube is expanded, penetrated, or otherwise altered, the piston no longer acts on the flow tube and the flow tube can be simply pushed down and locked in position with the flapper wide open.

19 Claims, 5 Drawing Sheets

METHOD OF DISABLING AND LOCKING OPEN A SAFETY VALVE WITH RELEASABLE FLOW TUBE FOR FLAPPER LOCKOUT

FIELD OF THE INVENTION

The field of this invention is downhole safety valves and more particularly those where the flapper can be locked open by shifting and locking the flow tube when disengaged from the power spring.

BACKGROUND OF THE INVENTION

SSSVs are normally closed valves that prevent blowouts if the surface safety equipment fails. Conditions can arise where the SSSV fails to function for a variety of reasons. One solution to this situation has been to lock open the SSSV and to gain access into the pressurized control system that is used to move the flow tube to push the flapper into an open position against the force of a closure spring that urges the valve into a closed position. Thereafter, a replacement valve is delivered, normally on wireline, and latched into place such that the newly formed access to the control system of the original valve is now straddled by the replacement valve. This allows the original control system to be used to operate the replacement valve.

There have been several variations of lock open devices in the past. U.S. Pat. No. 4,577,694 assigned to Baker Hughes teaches the use of a flapper lock open tool (FLO) which delivers a band of spring steel to expand when retaining sleeves on the FLO tool are retracted. The tool latches inside the SSSV and with the flow tube in the flapper-closed position the band is released. This design offered the advantages of the lockout device not being integral to the SSSV. Instead it was only introduced when needed through a wireline. Another advantage was that the release of the band did no damage to the SSSV or the FLO tool. The band expanded into a recessed area so as to allow full-bore through-tubing access. The flow tube did not have to be shifted so that no spring forces acting on the flow tube had to be overcome to actuate the FLO tool. Subsequently, when the SSSV was retrieved to the surface, the band was easily removed by hand without special tools. The FLO tool had safety features to prevent premature release or incorrect placement. The FLO tool did not require fluid communication with the control system, as its purpose was solely flapper lock out.

The FLO tool did have some disadvantages. One was that the band could become dislodged under high gas flow rates. The tool was complicated and expensive to manufacture. The expanding ring presented design challenges and required stocking a large variety to accommodate different conditions. The running method required two wireline trips with jar-down/jar-up activation.

U.S. Pat. No. 4,579,889 assigned to Camco, now Schlumberger, required latching in the SSSV and stroking the flow tube down to the valve open position. The flow tube would then be outwardly indented in the valve open position so that the indentations would engage a downwardly oriented shoulder to prevent the flow tube from moving back to the valve closed position. This design had some of the advantages of the Baker Hughes FLO design and could accomplish the locking open with a single wireline trip. The disadvantages were that the flow tube was permanently damaged and that the flow tube had to be forced against a closure spring force before being dimpled to hold that position. This made disassembly of the SSSV with the flow tube under spring pressure a potentially dangerous proposition when the valve was later brought to the surface.

U.S. Pat. No. 5,564,675 assigned to Camco, now Schlumberger, also involved forcibly pushing the flow tube against the spring to get the flapper into the open position. In fact, the flow tube was over-stroked to push the actuator piston out of its bore in the pressurized control system, at which point the piston would have a portion splay out preventing its re-entry into the bore, thereby holding the flow tube in the flapper open position. This design had the safety issues of disassembly at the surface where the flow tube was under a considerable spring force. Additionally, fluid communication into the control system was not an option when locking open using this tool.

U.S. Pat. No. 6,059,041 assigned to Halliburton uses a tool that forces the flow tube down to get the flapper in the open position. It then releases a band above the flow tube that lodges on a downwardly oriented shoulder to hold the flapper open. This system has the risk of a flow tube under a spring force causing injury when later disassembled at the surface. This tool is fluid activated and must overcome the spring force to get the flow tube to the flapper open position. Finally, the tool is fluid pressure actuated, which will require a long fluid column to eventually communicate with the formation, a particular disadvantage in gas wells.

Also of interest in the area of lock open devices for SSSVs are U.S. Pat. Nos. 4,624,315, 4,967,845 and 6,125,930 (featuring collet fingers on the end of the flow tube that engage a groove in the SSSV body).

One of the objectives of the present invention is to disconnect the flow tube from the power spring to facilitate pushing it down far enough to lock it in the flapper open position. The flow tube can be expanded and even slightly deformed or penetrated to operate the release between the hydraulic control system and the flow tube. Various locking devices are contemplated once a tool easily shifts the flow tube down to the flapper locked open position. These and other features of the present invention will be more readily understood from a review of the description of the preferred embodiment, and the claims, which appear below.

SUMMARY OF THE INVENTION

A safety valve has a lock open feature that is actuated by expanding or penetrating the flow tube to disconnect the link between the piston in the hydraulic control system and the flow tube. In normal operation, downward movement of the piston moves the flow tube against a power spring. When the flow tube is expanded, penetrated, or otherwise altered, the piston no longer acts on the flow tube and the flow tube can be simply pushed down and locked in position with the flapper wide open.

DETAILED DESCRIPTION OF THE PREFERRED EMBODIMENT

Figure 1A:
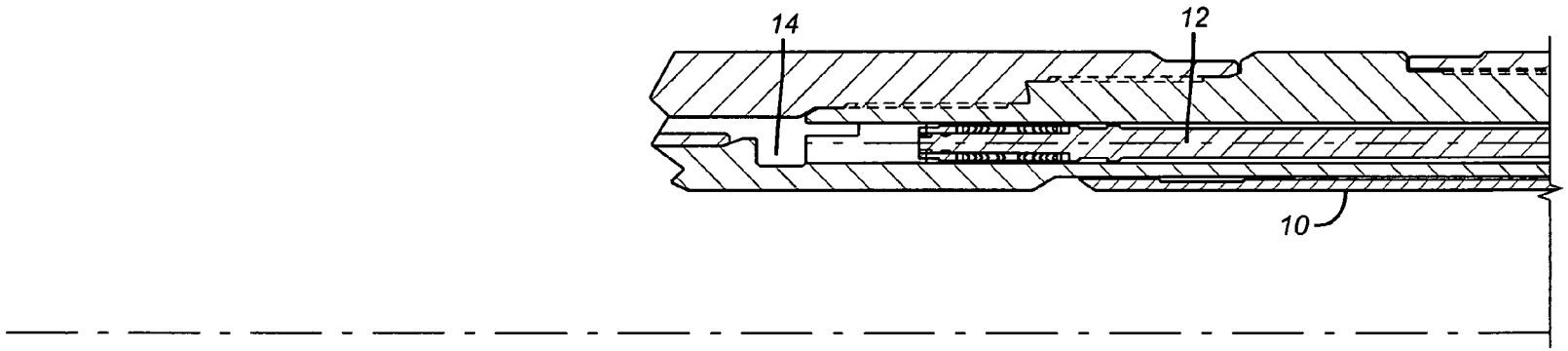
FIGS. 1*a*–1*b* show the normally closed valve position.
Figure 2A:
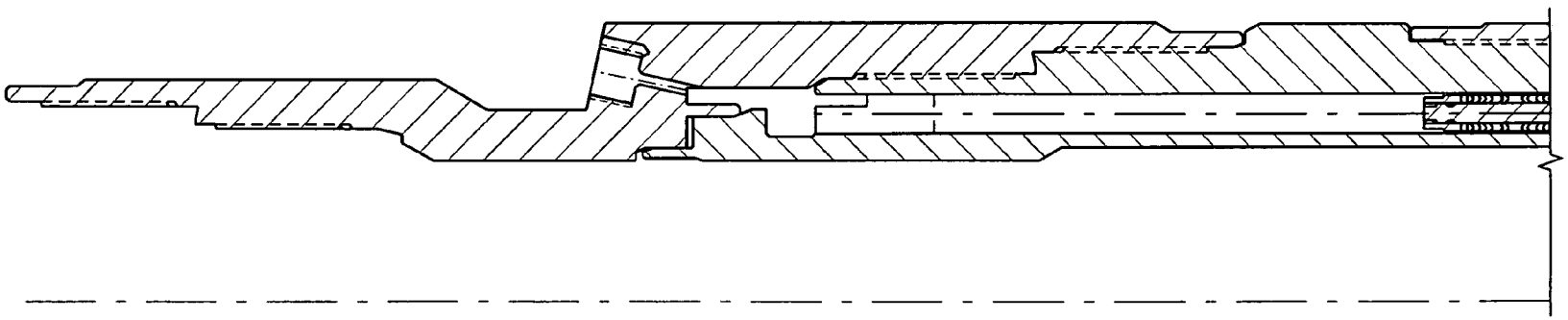
FIGS. 2*a*–2*b* show the open valve position.
Figure 1B:
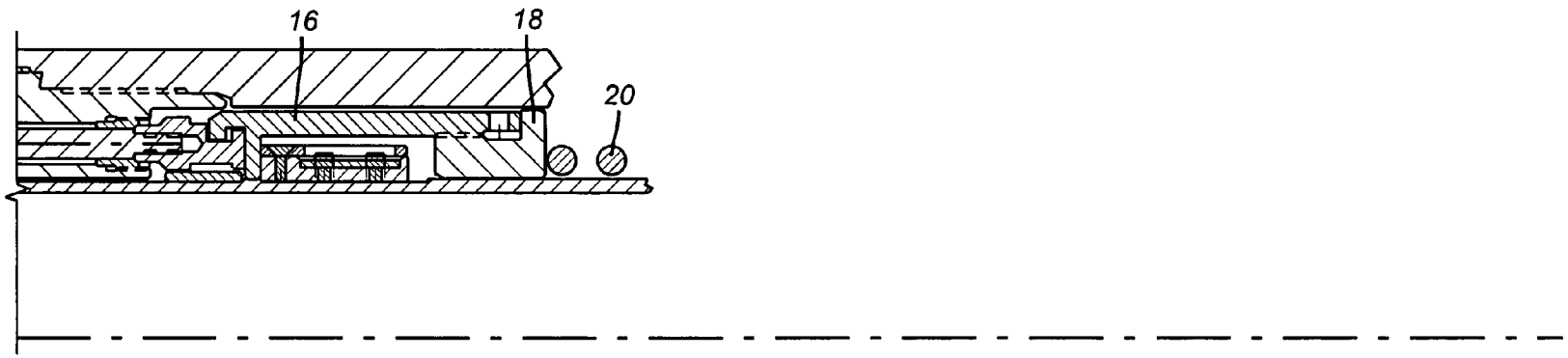
Figure 2B:
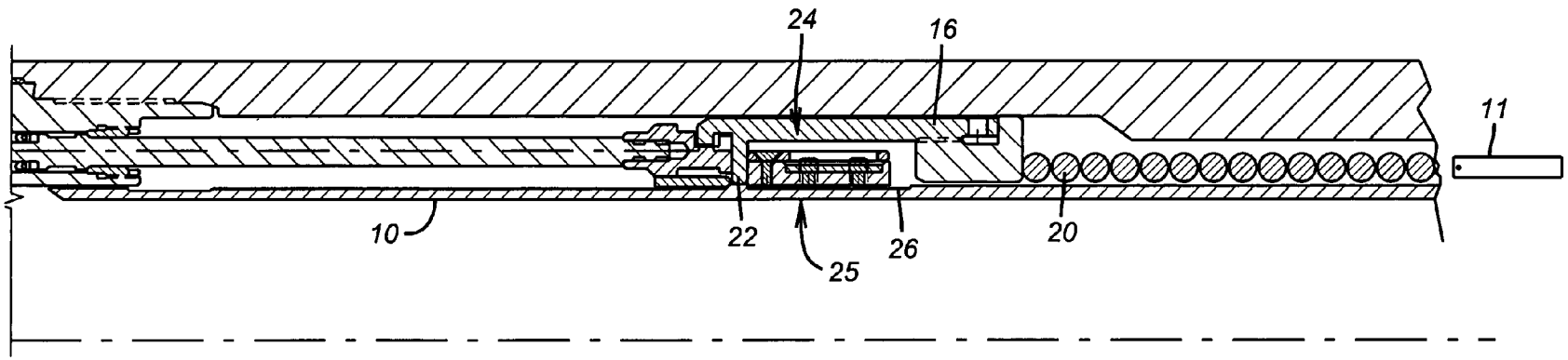
Figure 3A:
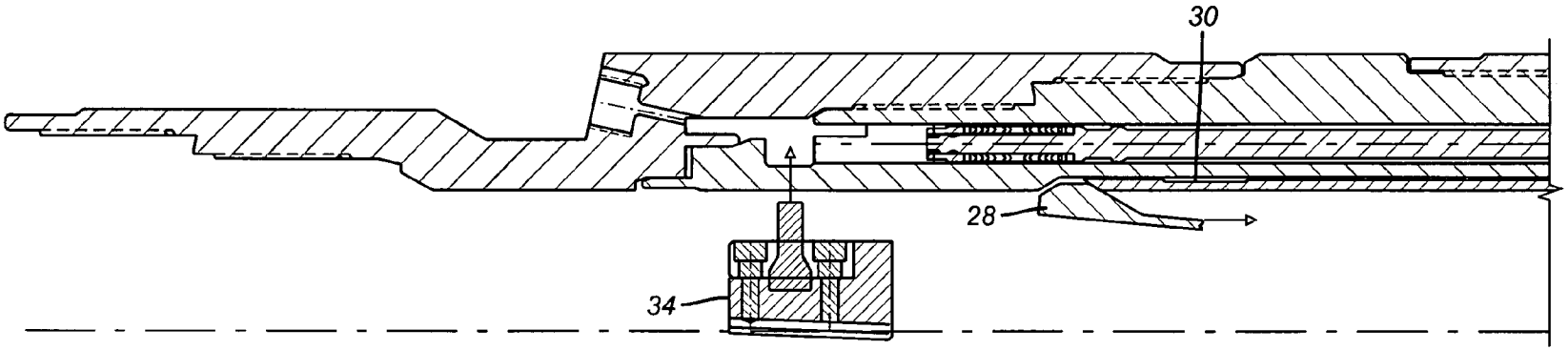
FIGS. 3*a*–3*b* show the tool in position to release the release ring.
Figure 4A:
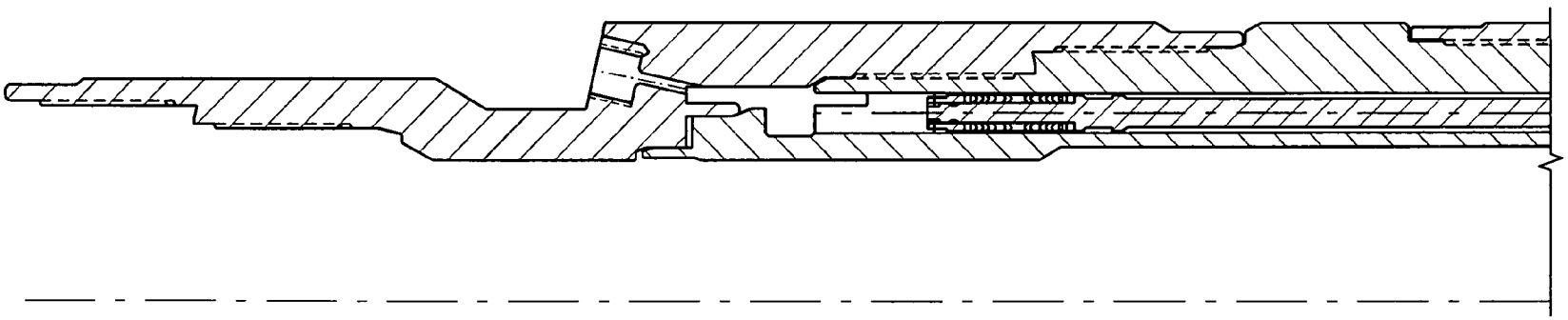
FIGS. 4*a*–4*b* show the tool with the release ring released and the flow tube pushed down and locked.
Figure 3B:
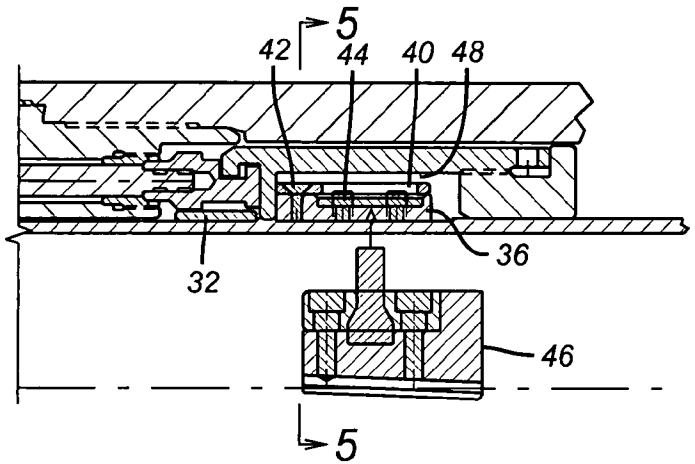
Figure 4B:
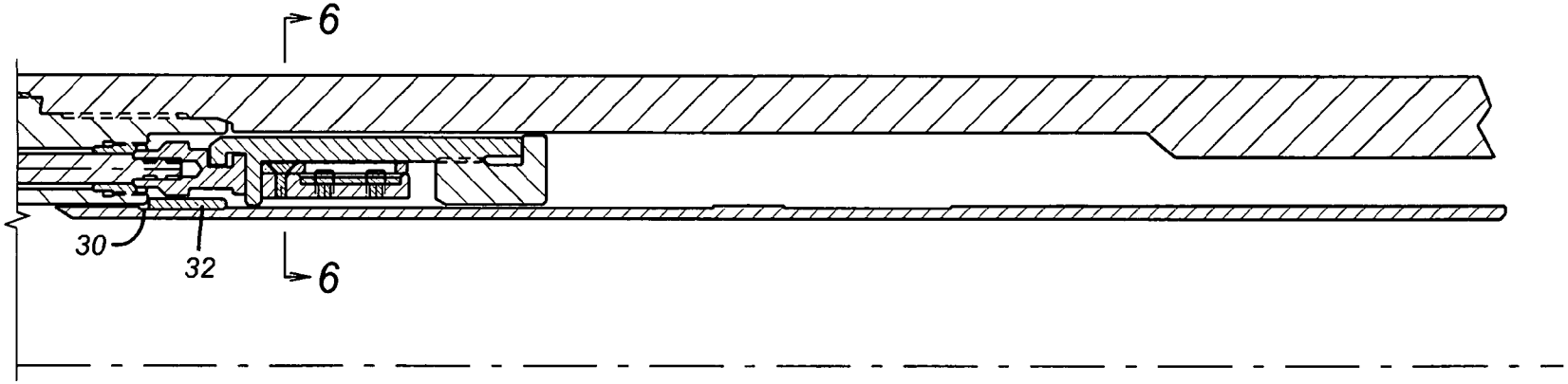
Figure 5:
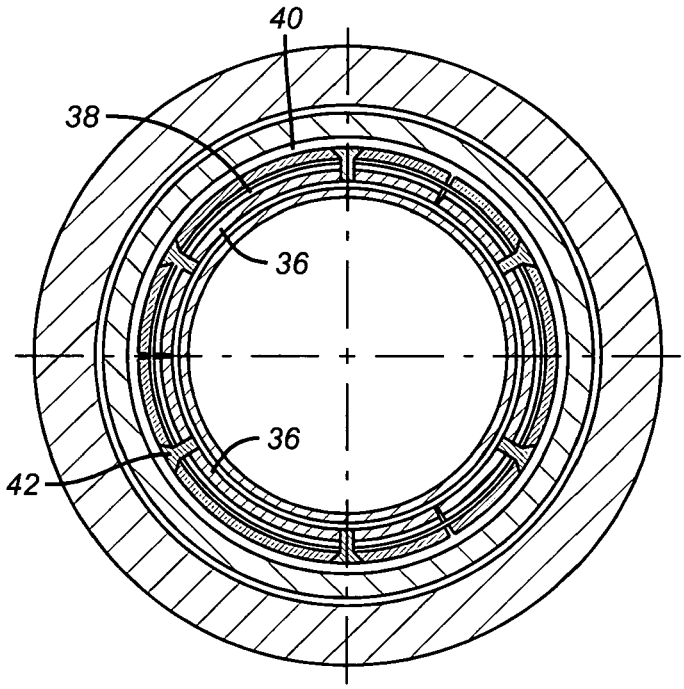
FIG. 5 is the view along lined 5—5 of FIG. 3*b*.

The specific portions of a SSSV are shown that are necessary for those skilled in the art to understand the invention. The other components are known and operate in a known manner and will not be discussed at length. During normal operations a flow tube 10 is secured to a piston 12 SO that pressure from the surface in annular chamber 14 drives the piston 12 and with it the flow tube 10 downwardly to force open a flapper 11 for the valve open position. Downward movement of the piston 12 takes with it ring 16 and, in turn, sleeve 18. Sleeve 18 bears on power spring 20. Power spring 20 goes from a relaxed position when the flow tube is in the up or valve closed position to a compressed position when the Valve is in the open position with the flow tube 10 pushed down. Spring 20 is shown fully compressed in FIG. 2*b* with the flow tube 10 fully pushed down. Ring 16 has a radial component 22, which bears on release ring 24. During normal operations, release ring 24 is mounted firmly in groove 26 on the outer surface of the flow tube 10. Accordingly, when radial component 22 is driven down it pushes down the release ring 24, which, in turn, pushes down the flow tube 10 because the release ring is secured in groove 26. With the release ring intact, the control system operates the SSSV in a known manner.

Figure 6:
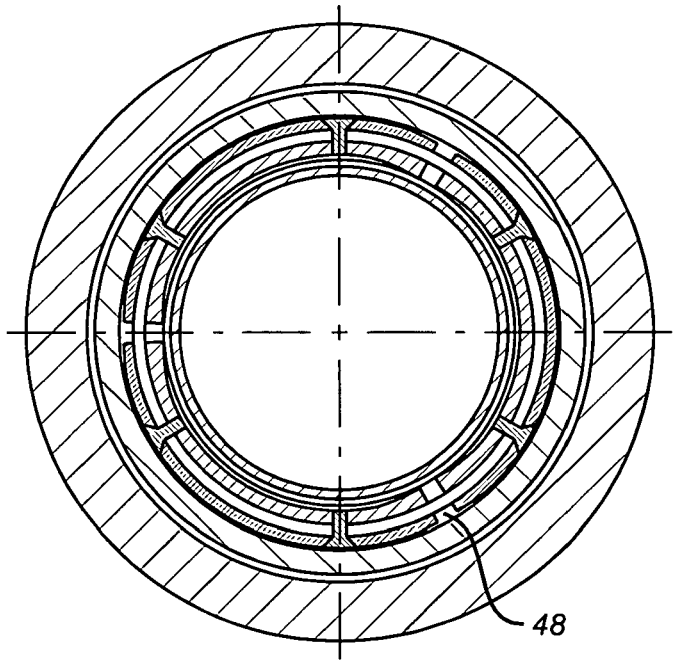
FIG. 6 is the view along lines 6—6 of FIG. 4*b*.

However, the locking feature for the SSSV using the flow tube 10 and the release ring 24 comprises an aspect of the invention. In summary, when the release ring 24 is freed from groove 26, the flow tube 10 can be moved down with a known shifting tool 28 without compressing the power spring 20. Bringing down the flow tube 10 in this manner, places a groove 30 in alignment with a lock, which is preferably a C-shaped ring 32 that can spring inwardly into groove 30 to lock the flow tube in the down position. The flapper 11 is then held open. Optionally, a known penetrating tool 34 can penetrate into annular chamber 14, to get access to control system pressure for a replacement SSSV. p The construction of the release ring 24 is related to the manner in which it is released. Internally, and extending into groove 26 are a series of segments 36 held by a band 38. Band 38 has an outward bias that is resisted by cover band 40. Screws 42 secure cover band 40 to segments 36. Screws 44 secure segments 36 to band 38. A known penetrating tool 46 can penetrate the flow tube 10 in the area of groove 26 to push segments 36 until cover band 40 releases its grip on segments 36. At that time band 38 moves the segments apart due to its outward built in bias on assembly. Gaps 48 open between the segments 36, as shown in FIG. 6. Segments 36 move out of groove 26 and subsequent movement of the flow tube 10 by shifting tool 28 can be made without compression of spring 20. Instead of using a penetrating tool to defeat the release ring 24 a known expansion tool, shown schematically as 25. can force the release ring 24 out far enough to break the connection between the cover band 40 and the segments 36 to allow them to separate and be biased out of groove 26 by band 38. There is enough clearance 48.to ring 16 to allow the release ring 24 to come apart so that the locking open procedure can be initiated.

While the preferred embodiment is illustrative, those skilled in the art should appreciate that the invention encompasses any device that released the connection between the flow tube 10 and the operating piston 12 with its return spring 20. One advantage that can be achieved in that instance is that the flow tube is advanced and locked in the flapper open position without having a need to overcome the power spring 20. Optionally, in a single trip, access to the annular chamber 14 can be obtained at the same time as defeating the release ring 24 and stroking the flow tube 10 with shifting tool 28.

The foregoing disclosure and description of the invention are illustrative and explanatory thereof, and various changes in the size, shape and materials, as well as in the details of the illustrated construction, may be made without departing from the spirit of the invention.

I claim:

1. A method of disabling and locking open a safety valve, comprising:

releasing a piston that is connected to a flow tube from said flow tube;

shifting the flow tube from within said flow tube so that it opens the flapper;

locking the flow tube in position after said shifting.

2. The method of claim 1, comprising:

shifting the flow tube, after said selectively releasing, so that it opens the flapper;

accomplishing said selectively releasing and said shifting of said flow tube in a single trip downhole.

3. A method of locking open a safety valve, comprising:

selectively releasing a piston from a flow tube;

shifting the flow tube from within said flow tube so that it opens the flapper;

shifting the flow tube, after said selectively releasing, so that it opens the flapper;

not compressing a power spring when shifting said flow tube after said selective releasing.

4. A method of locking open a safety valve, comprising:

selectively releasing a piston from a flow tube;

shifting the flow tube so that it opens the flapper;

shifting the flow tube, after said selectively releasing, so that it opens the flapper;

expanding said flow tube to accomplish said selective releasing.

5. A method of locking open a safety valve, comprising:

selectively releasing a piston from a flow tube;

shifting the flow tube so that it opens the flapper; shifting the flow tube, after said selectively releasing, so that it opens the flapper; penetrating said flow tube to accomplish said selective releasing.

6. A method of disabling and locking open a safety valve, comprising:

releasing a piston that is connected to a flow tube from said flow tube;

shifting the flow tube from within said flow tube so that it opens the flapper;

locking the flow tube in position after said shifting;

springing a lock into position to hold said flow tube as a result of said shifting of said flow tube.

7. A method of locking open a safety valve, comprising:

selectively releasing a piston from a flow tube;

shifting the flow tube so that it opens the flapper;

shifting the flow tube, after said selectively releasing, so that it opens the flapper;

locking the flow tube in position after said shifting;

springing a lock into position to hold said flow tube as a result of said shifting of said flow tube;

providing a groove in said flow tube;

allowing a ring to snap into said groove to lock the position of said flow tube.

8. A method of locking open a safety valve, comprising:

selectively releasing a piston from a flow tube;

shifting the flow tube from within said flow tube so that it opens the flapper;

shifting the flow tube, after said selectively releasing, so that it opens the flapper;

providing a connector between said piston and said flow tube;

causing said connector to fail.

9. The method of claim 8, comprising:

compressing a power spring with said connector when said piston moves and said connector has not yet been caused to fail.

10. A method of locking open a safety valve, comprising:

selectively releasing a piston from a flow tube;

shifting the flow tube from within said flow tube so that it opens the flapper;

shifting the flow tube, after said selectively releasing, so that it opens the flapper;

providing a connector between said piston and said flow tube;

causing said connector to fail;

providing segments held together with at least one fastener as said connector.

11. The method of claim 10, comprising: shearing said fastener.

12. The method of claim 11, comprising: locking the flow tube in position after said shifting.

13. The method of claim 12, comprising:

springing a lock into position to hold said flow tube as a result of said shifting of said flow tube.

14. A method of locking open a safety valve, comprising:

selectively releasing a piston from a flow tube;

shifting the flow tube so that it opens the flapper;

shifting the flow tube, after said selectively releasing, so that it opens the flapper;

providing a connector between said piston and said flow tube;

causing said connector to fail;

providing segments held together with at least one fastener as said connector;

surrounding said flow tube with said segments;

surrounding said flow tube with said segments.

15. The method of claim 14, comprising:

causing said connector to fail by expansion of said flow tube adjacent said connector.

16. The method of claim 14, comprising:

causing said connector to fail by penetration of said flow tube and displacement of at least one of said segments.

17. A method of locking open a safety valve, comprising:

selectively releasing a piston from a flow tube;

shifting the flow tube so that it opens the flapper;

shifting the flow tube, after said selectively releasing, so that it opens the flapper;

providing a connector between said piston and said flow tube;

causing said connector to fail;

providing segments held together with at least one fastener as said connector;

shearing said fastener;

locking the flow tube in position after said shifting;

springing a lock into position to hold said flow tube as a result of said shifting of said flow tube;

providing a groove in said flow tube;

allowing a ring to snap into said groove to lock the position of said flow tube.

18. A method of locking open a safety valve, comprising:

selectively releasing a piston from a flow tube by expanding the flow tube;

shifting the flow tube, after said selectively releasing, so that it opens the flapper;

accomplishing said selectively releasing and said shifting of said flow tube in a single trip downhole;

running in a combination expansion and shifting tool to accomplish said releasing and said shifting.

19. A method of locking open a safety valve, comprising:

selectively releasing a piston from a flow tube by penetration through said flow tube;

shifting the flow tube, after said selectively releasing, so that it opens the flapper;

accomplishing said selectively releasing and said shifting of said flow tube in a single trip downhole;

running in a combination penetration and shifting tool to accomplish said releasing and said shifting.

* * * * *